US008612101B2

(12) United States Patent
Pruessel et al.

(10) Patent No.: US 8,612,101 B2
(45) Date of Patent: Dec. 17, 2013

(54) METHOD FOR DETERMINING A POSITION POINT OF A MOVABLE ELEMENT

(75) Inventors: Holger Pruessel, Buehlertal (DE); Paul Lecoultre, Gambsheim (FR); Fabrice Duval, Budapest (HU); Laurent Beyer, Oberhoffen sur Moder (FR)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/262,762

(22) PCT Filed: Mar. 17, 2010

(86) PCT No.: PCT/EP2010/053429

§ 371 (c)(1),
(2), (4) Date: Jan. 3, 2012

(87) PCT Pub. No.: WO2010/112336

PCT Pub. Date: Oct. 7, 2010

(65) Prior Publication Data

US 2012/0095650 A1 Apr. 19, 2012

(30) Foreign Application Priority Data

Apr. 3, 2009 (DE) ..... 10 2009 002 172

(51) Int. Cl.
*G06F 19/00* (2011.01)

(52) U.S. Cl.
USPC ..... 701/49

(58) Field of Classification Search
USPC ..... 701/49
See application file for complete search history.

(56) References Cited

U.S. PATENT DOCUMENTS

| | | | | |
|---|---|---|---|---|
| 5,497,326 | A | 3/1996 | Berland et al. | |
| 6,194,855 | B1 | 2/2001 | Lochmahr et al. | |
| 6,208,101 | B1 | 3/2001 | Seeberger et al. | |
| 6,870,339 | B2 * | 3/2005 | Kessler et al. | 318/468 |
| 7,093,887 | B2 * | 8/2006 | Mrkovic et al. | 296/155 |
| 7,305,290 | B2 * | 12/2007 | Russ et al. | 701/36 |
| 7,791,299 | B2 | 9/2010 | Eichin | |
| 8,089,230 | B2 * | 1/2012 | Fuchs et al. | 318/286 |
| 2002/0152013 | A1 | 10/2002 | Knab et al. | |
| 2002/0190680 | A1 * | 12/2002 | Gerbetz | 318/445 |
| 2009/0198420 | A1 * | 8/2009 | Newman et al. | 701/49 |
| 2011/0071735 | A1 * | 3/2011 | Witek | 701/49 |
| 2011/0160935 | A1 * | 6/2011 | Newman et al. | 701/2 |

FOREIGN PATENT DOCUMENTS

DE 102004011332 9/2005

OTHER PUBLICATIONS

PCT/EP2010/053429 International Search Report dated Jun. 21, 2010 (2 pages).

* cited by examiner

*Primary Examiner* — Thomas Tarcza
*Assistant Examiner* — Alex C Dunn
(74) *Attorney, Agent, or Firm* — Michael Best & Friedrich LLP

(57) ABSTRACT

The invention relates to a method for determining a position point of a movable element, particularly a window (33) or a roof of a motor vehicle that can be advanced into at least one elastic receptacle (36) by means of a drive, comprising the steps of continually determining a spring stiffness in relation to the moving element (33) in the elastic receptacle (36) and determining a position point upon exceeding a specified spring stiffness threshold value.

20 Claims, 3 Drawing Sheets

METHOD FOR DETERMINING A POSITION POINT OF A MOVABLE ELEMENT

BACKGROUND OF THE INVENTION

The invention relates to a method for determining a position point of a movable element, particularly of a window or of a roof of a motor vehicle which can be advanced into at least one elastic receptacle by means of a drive.

Movable elements, in particular windows or roofs, are used, for example, in motor vehicles as electric activated windows or as electric activated sunroofs. The electric closing devices of the windows or roofs which are provided for this purpose have to ensure both a trapping protection, in order to largely prevent injury to the user as a result of trapping body parts, and move the movable element safely into an elastic receptacle, with the result that the movable element, together with the elastic receptacle, seals off the passenger compartment of the vehicle from external weather influences.

EP 0 883 724 B1 describes an adjustment drive having trapping protection for movable elements, in which the rotational speed and/or the power of the adjustment drive is lowered according to a predefined mathematical function in a specific adjustment range within a predefined position region before the movable element advances into an elastic receptacle, with the result that the movable element advances into the elastic receptacle at a minimum speed. The position for the stopping of the movable element is determined here from the indirectly measured position thereof.

The position for the stopping of the movable element is subject to wear, voltage fluctuations in the on-board power system of the vehicle or climatic influences on the closing device, with the result that the desired stopping position often does not correspond to the stopping position which is adopted. In order to avoid this, EP 0 697 305 A1 proposes an adjustment drive for windows and sunroofs having a control system which determines the position of the movable element from the power drain of the motor. Locking of the electric motor of the drive is inferred from an increase in the current profile, and stopping of the drive is initiated. This procedure leads to a situation in which the movable element advances into the elastic element in an unbraked fashion and gives rise to clearly audible noise in this way.

SUMMARY OF THE INVENTION

The object of the invention is to make available a method for determining a position point of a movable element, which method reliably determines the desired position point of the movable element.

The invention recognizes that the locking of a drive of a drive system of a movable element can be avoided by continuously determining and monitoring a spring stiffness during the movement of the movable element, wherein a position point is determined when a threshold value of the drive is exceeded.

This ensures that the determined position point of the movable element, for example an electrically activated window or an electrically activated sunroof of a motor vehicle, is reliably determined independently of climatic influences, the wear of the elastic receptacle or of the drive system of the movable element.

According to one embodiment of the invention, after a defined number of advance processes into the elastic receptacle, the position point is determined once more. This has the advantage that the position point is not only adapted to the wear of the elastic receptacle and of the drive system but also to climatic changes, for example fluctuations in temperature.

BRIEF DESCRIPTION OF THE DRAWINGS

The invention will be explained in more detail below with reference to figures, in which.

DETAILED DESCRIPTION

The determination of the position point on the basis of the determination of a stopping position in a soft stop region is demonstrated below, wherein the position point corresponds in its position and in its determination to the stopping point.

Figure 1:
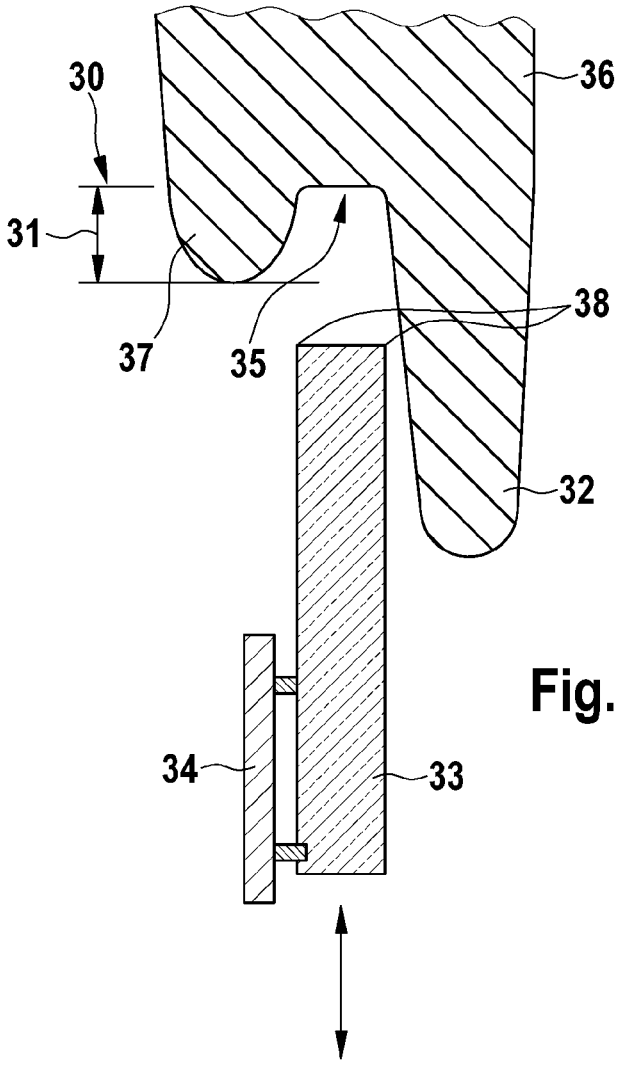
FIG. 1 shows a schematic side view of a window during the advancing into an elastic receptacle.

FIG. 1 shows a schematic sectional view of a window 33 as a movable element during the advancing into an elastic receptacle 36. The window 33 is moved by a window lifter 34, with the result that the passenger compartment of a motor vehicle is opened or closed. In order to open or close the window 33, the latter can be moved downward or upward. The window 33 is guided laterally in guides (not illustrated) of the vehicle door here. The elastic receptacle 36 has two sealing lips 32, 37, where the sealing lips 32, 37 are separated from one another by a recess 35. When the window 33 advances into the receptacle 35 during a closing process, the window 33 is sealed at its upper edges 38 by contact and by overlapping with the sealing lips 32, 37. When the window 33 advances into the recess 35, the drive of the window lifter 34 is switched off as soon as the window 33 advances with its upper edge 38 into a soft stop region 31. The soft stop region 31 constitutes a tolerance region in which the upper edge 38 of the window 33 comes to a standstill without compressing the elastic receptacle 36, but at the same time the passenger compartment of the motor vehicle is reliably closed off. The desired soft stop region 31 corresponds approximately to the depth 30 of the recess 35. Stopping position is understood to be the position of the upper edge 38 of the window 33 in which it comes to a standstill. The stopping position can also be located outside the soft stop region 31. If the window 33 moves so far into the elastic receptacle 36 that the window 33 compresses the elastic, this gives rise to locking of the electric motor of the window lifter 34 and to unnecessary wear of the window lifter in that the mechanism of the window lifter comes to a standstill under stress. The drive of the window lifter 34 is not usually switched off until the latter is locked or a specific position of the window 33 which has been stored in a control device is passed through. As a result of climatic changes, for example fluctuations in temperature, as well as wear of the window lifter 34, the desired stopping position of the upper edge 38 of the window 33 changes, with the result that the drive of the window lifter 34 is stopped too late and the window 33 compresses the elastic receptacle 36 in such a way that the closing process generates noise.

In the embodiment, the force profile for the advancing of the window 33 into the elastic receptacle 36 is observed indirectly. The dip in the rotational speed of the electric motor of the window lifter 34 is used to determine the force. For this purpose, the electric motor has a rotational speed sensor with, for example, a Hall sensor. The number of completed revolutions and therefore the position of the window 33 can also be determined by means of the rotational speed sensor.

In a further embodiment of the invention, the stopping point is used as a position point for calibrating a further system, in particular an anti-trapping system. This has the advantage that the further system can be adapted to wear, voltage fluctuations of the on-board power system or climatic conditions over the service life of the system.

Figure 2:
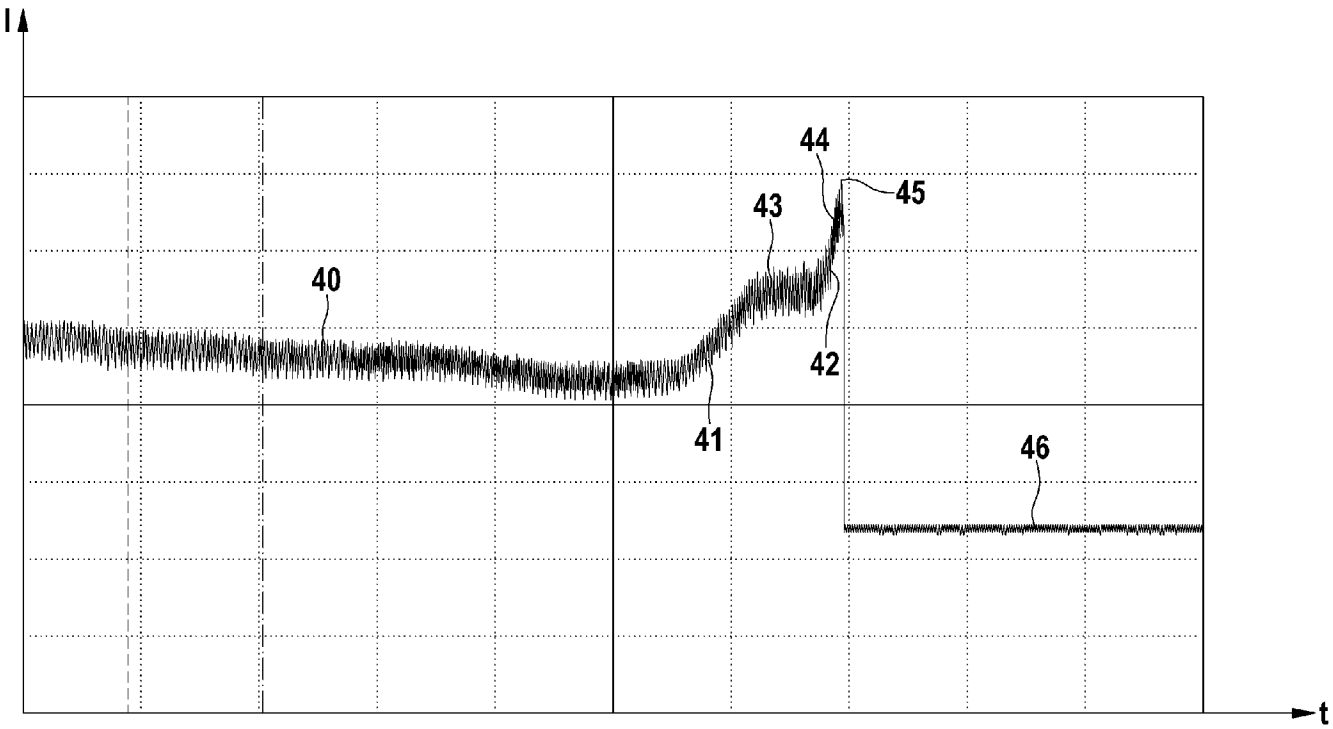
FIG. 2 shows the current profile of an electric motor plotted over time.

FIG. 2 shows a diagram of the current profile plotted over time. In this context, the current profile exhibits, in the left-hand half of the diagram, a virtually horizontal profile which corresponds to the opening process or closing process of the window 33 (shown in FIG. 1) by the window lifter 34. If the window 33 touches the sealing lip 32, 37 with its upper edge 38 during the closing process, an increased application of force is necessary to move the window 33. The increased application of force results in a relatively low rotational speed of the electric motor of the window lifter 34 and in an increased power drain. As a result, the illustrated profile of the power drain corresponds to the required force profile or to the change in force to close the window 33. As a result of the movement of the window 33 along the sealing lips 32, 37, the power drain increases in the region 41 owing to the slightly tapering side faces of the recess 35.

As soon as the required force for advancing the window 33 into the recess 35 has reached a steady state, the power drain forms a plateau-shaped region 43. When the window 33 is moved further into the recess 35 by the window lifter 34, the recess 35 tapers to a greater extent in its upper region, with the result that the application of force to move the window 33 increases in the region 44. After a specific threshold value of the power drain has been exceeded 45, the drive is switched off and drops to zero in the region 46 in order to prevent locking of the drive. The increase in the recorded force profile or current profile corresponds to a spring stiffness. The spring stiffness is dependent here on the position of the upper edge 38 in the elastic receptacle 36. The deeper the extent to which the upper edge 38 advances into the recess 35, the greater the increase in the spring stiffness. If the spring stiffness exceeds a threshold value, the drive of the window lifter 34 is stopped. Locking and stressing of the window lifter 34 can be avoided by prompt stopping 45 of the drive.

Figure 3:
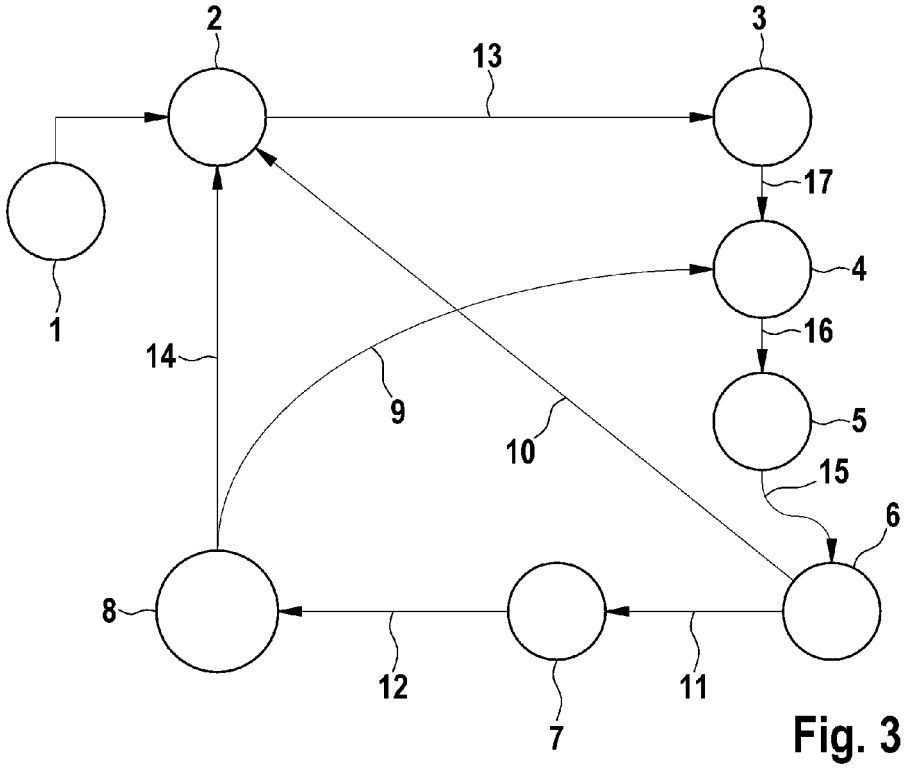
FIG. 3 shows a flowchart of the method according to the invention.

FIG. 3 shows a flowchart of the method according to the invention, wherein both the stopping position in the soft stop region is detected and a stopping position is re-learnt. In the original state 1, the control device does not have a stored value of the stopping position of the window 33 of the window lifter 34 which is illustrated in FIG. 1 but only has the threshold values for force and spring stiffness which are necessary for the method according to the invention but are vehicle specific. When the window lifter 34 is activated, the value zero is assigned to a counter in the state 2 in the control device. When the window lifter 34 is moved for the first time, the stopping positions for a closed window or opened window of the window lifter 34 are not known. The stopping positions are determined, for example, by moving the window 33 into the elastic receptacle 36 shown in FIG. 1 until the window 33 can no longer be moved and the drive locks at the event 13. This position is stored in a memory of the control device in the state 3. The learning of the stopping position is necessary since the stopping position serves as a predefined value for a tolerance range in the rest of the method.

When the window is moved once more during a further closing process, for example in the state 9 or 17, the position of the window 33 is monitored by using the number of rotations of the electric motor located in the window lifter 34 to calculate the distance by which the window 33 moved, using the transmission ratio of the window lifter 34. For this purpose, the electric motor has a sensor which, for example, as a Hall sensor which detects the rotations of the electric motor. By virtue of the detection of the rotations of the electric motor, the control device can also determine the movement speed of the window lifter 34.

In state 4, the control device monitors the position of the upper edge 38 of the window 33 during the movement. If the upper edge 38 of the window 33 is in the soft stop region of the elastic receptacle 36 at the event 16, the control device starts the force monitoring. In this optional event, the current absolute force of the electric motor is determined. As a result, it is possible, for example, to filter out hard impacting of the window 33 in the elastic receptacle 36. The soft stop region of the elastic receptacle 36 corresponds to a predefined value, the absolute position of said region being dependent on the stopping position determined by means of the state 3. The force or the change in force can be determined from the decrease in rotational speed of the electric motor of the window lifter 34. If the force is determined from the rotational speed, the greater the decrease in the rotational speed of the electric motor the greater the increase in the application of force to move the window 33. However, the force can also take place on the basis of the power drain of the electric motor or by means of direct force measurement at at least one of the components of the window lifter 34. If the force at the event 15 exceeds, during the observation of said force in the state 5, a threshold value which is stored in the control device, the control device thus carries out a test to determine whether the soft stop function is available in the state 6. The soft stop function is understood to mean that the window lifter advances the window 33 into the elastic receptacle 36, but stops the electric motor in good time so that the window 33 is not moved at its maximum speed up to the end of the recess 35 and compresses the elastic receptacle. This ensures that the closing of the window 33 is completed without significant noise which occurs if the soft stop function is not available. If the soft stop function is not available owing to disruption at the event 10, the window 33 is moved into the elastic receptacle 36 and stopped when the electric motor locks, and the electric motor is switched off.

If the stop soft function is available at the event 11, the control device, when triggered by the threshold value of the force being exceeded, observes a spring stiffness at the event 15. The spring stiffness can be determined from the force or from the change in force and the distance moved. In this context, the spring stiffness is locally dependent and can therefore be used to position the window 33. If the spring stiffness exceeds a threshold value at the event 12 during the observation in the state 7, the motor is stopped in the state 8. The stopping position which is determined in the soft stop region of the upper edge 38 of the window 33 has the advantage that the elastic receptacle 36 is not compressed and the upper edge 38 of the window 33 is seated securely in the elastic receptacle 36. Furthermore, in state 8 the value one is added to the present value of the counter of state 2. If the new value of the counter corresponds, to a predefined second value and there is a comparison in the state 8, the counter is reset again to zero at the event 14, and a new advancing process of the window 33 starts from the state 2. If the new value of the counter at the event 9 does not correspond to the predefined, second value, the value of the counter remains unchanged. If the window lifter 34 is moved once more, the next advancing process of the window lifter 34 does not start in the state 2 but rather in the state 4.

The resetting of the counter has the advantage that the stopping position of the upper edge 38 of the window 33 into the recess 35 is checked at regular intervals. In this way, the window lifter 34 can be adapted automatically to wear or to changed climatic conditions since the stopping position is re-determined at regular intervals.

In addition it is conceivable that the stopping position which is determined is compared with further, previously determined stopping positions, in order to detect faults or defects in the mechanism of the window lifter. The previous stopping positions can be stored, for example, in a storage unit in the control device in order to compare them with the determined stopping position.

Figure 4:
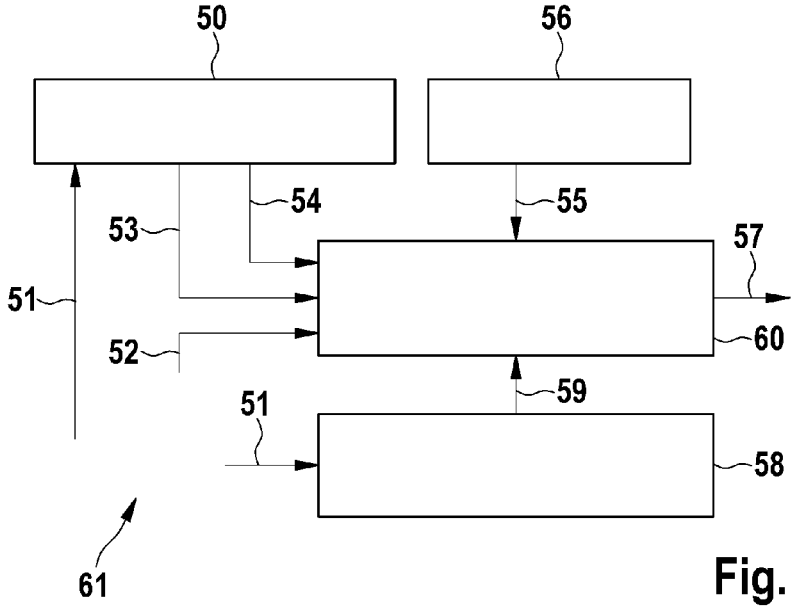
FIG. 4 shows a schematic design of a control device according to the invention.

FIG. 4 shows a schematic design of a control device 61 according to the invention. In this context, various modules of a control device 61 of the window lifter 34 which is shown in FIG. 1 are illustrated symbolically as rectangles. The control device 61 has here a first module 50 for evaluating the force and the spring stiffness, as well as a fourth module 56 which determines locking of the drive and determines a stopping position of the window 33. Furthermore, the control device 61 has a third module 58 which checks whether a second module 60 is available. The individual modules 50, 56, 60, 58 can be linked to one another by means of data paths 51 to 55, 59 via which information is transmitted. In this context, the dynamic information, for example voltage or motor speed of the electric motor of the drive, is transmitted via the data path 51 to the first and third modules 50, 58. The first module 50 determines from this information the force moving the window 33 and the spring stiffness. The second module 60 determines the stopping position of the window 33 from the available information by comparing the spring stiffness with a threshold value, and stops the drive by means of a data path 57. Likewise, the second module 60 stops the drive if the fourth module 56 transmits information about a locked state of the drive via the data path 55. The information as to whether the soft stop function of the third module 58 is available is made available via the data path 59. Like the first module 50, the third module 58 receives dynamic information about the drive via the data path 51. By means of the information which is transmitted via the data paths 51 to 55, 59, the fourth module 60 can determine a stopping position which is in the soft stop region, with the result that the wear of the window lifter and the generation of noise during the advancing into the elastic receptacle 36 are reduced.

The person skilled in the art is, of course, familiar with the fact that the sequence of the individual method steps is exemplary, but it is essential here that a spring stiffness is used to determine the position point or the stopping point of a movable element in order to determine reliably and independently the position of the movable element during the advancing into an elastic receptacle, for example during the opening and closing of a window of a motor vehicle.

The invention claimed is:

1. A method for determining a position point in a soft stop region of a movable element which can be advanced into at least one elastic receptacle (36) by means of a drive, comprising the following steps:

continuously determining the spring stiffness in the soft stop region in relation to the element (33) which moves into the elastic receptacle (36), and determining the position point when a predefined threshold value of the spring stiffness is exceeded, the position point being at a position where the element (33) is seated securely in the elastic receptacle (36) and the elastic receptacle (36) is not compressed.

2. The method as claimed in claim 1, characterized in that the spring stiffness is determined from a change in force and the distance by which the moving element moves.

3. The method as claimed in claim 2, characterized in that the determination of the change in force is started when a predefined position of the movable element is reached.

4. The method as claimed in claim 1, characterized in that the position point serves to calibrate a further system.

5. The method as claimed in claim 1, characterized in that the drive is stopped at the position point.

6. The method as claimed in claim 1, characterized in that the position point which is determined is compared with a predefined position point in order to check the plausibility of the position point which is determined.

7. The method as claimed in claim 4, characterized in that, after a defined number of advancing processes into the elastic receptacle, the predefined position point is re-defined.

8. The method as claimed in claim 1, characterized in that the method can be switched off.

9. A control device (61) for actuating a drive, wherein the drive moves a movable element into an elastic receptacle (36), characterized in that the control device (61) has a first module (50) for determining a spring stiffness, and a second module (60) for comparing the spring stiffness with a threshold value, wherein the second module (60) of the control device (61) determines a position point when the spring stiffness exceeds a threshold value, the position point being at a position in a soft stop region where the element (33) is seated securely in the elastic receptacle (36) and the elastic receptacle (36) is not compressed.

10. The control device (61) as claimed in claim 9, characterized in that the second module (60) stops the drive at the position point.

11. The control device (61) as claimed in claim 9, characterized in that the position point serves to calibrate a further system.

12. The control device (61) as claimed in claim 9, characterized in that the control device (61) has a storage unit in which at least one position point, the threshold value of the force and the threshold value of the spring stiffness are stored.

13. The method as claimed in claim 1, characterized in that the movable element is a window (33) or a roof of a motor vehicle.

14. The method as claimed in claim 4, characterized in that the further system is an anti-trapping system.

15. The control device (61) as claimed in claim 9, characterized in that the movable element is a window (33) of a motor vehicle.

16. The control device (61) as claimed in claim 9, characterized in that the movable element is a roof of a motor vehicle.

17. The control device (61) as claimed in claim 11, characterized in that the further system is an anti-trapping system.

18. The control device (61) as claimed in claim 9, characterized in that the control device (61) has a storage unit in which at least one position point is stored.

19. The control device (61) as claimed in claim 9, characterized in that the control device (61) has a storage unit in which the threshold value of the force is stored.

20. The control device (61) as claimed in claim 9, characterized in that the control device (61) has a storage unit in which the threshold value of the spring stiffness is stored.

* * * * *